US007357006B2

(12) United States Patent
Kim et al.

(10) Patent No.: US 7,357,006 B2
(45) Date of Patent: Apr. 15, 2008

(54) GASKET AND DRUM-TYPE WASHING MACHINE HAVING THE SAME

(75) Inventors: Jae Kyum Kim, Gimhae-si (KR); Geon Kim, Jinhae-si (KR); Chi Wan Hur, Changwon-si (KR); Yu Beom Kang, Changwon-si (KR); Sang Man Je, Koje-si (KR)

(73) Assignee: LG Electronics Inc., Seoul (KR)

( * ) Notice: Subject to any disclaimer, the term of this patent is extended or adjusted under 35 U.S.C. 154(b) by 623 days.

(21) Appl. No.: 10/926,056

(22) Filed: Aug. 26, 2004

(65) Prior Publication Data

US 2005/0178169 A1 Aug. 18, 2005

(30) Foreign Application Priority Data

Feb. 13, 2004 (KR) ..... 10-2004-0009702

(51) Int. Cl.
*D06F 37/00* (2006.01)

(52) U.S. Cl. ..... 68/23.1; 68/139; 68/196

(58) Field of Classification Search ..... 68/3 R, 68/20, 24, 58, 139, 140, 142
See application file for complete search history.

(56) References Cited

U.S. PATENT DOCUMENTS 3,276,229 A * 10/1966 Deiss ..... 68/139
6,256,823 B1 * 7/2001 Kronbetter et al. ..... 8/158
2004/0163426 A1 * 8/2004 Kim et al. ..... 68/23 A

* cited by examiner

*Primary Examiner*—Joseph L. Perrin
(74) *Attorney, Agent, or Firm*—McKenna Long & Aldridge LLP

(57) ABSTRACT

A gasket and washing machine having the same prevent laundry from becoming wedged between a drum and a gasket for preventing water leakage. The gasket is coupled between a cabinet of a drum-type washing machine including a drying duct for providing a drying function and a tub disposed inside the cabinet. The gasket includes an annular lip, protruding inwardly from an inner circumference of the gasket, for preventing foreign matter from entering a space existing between the tub and a rotating drum, and a laundry kicker, protruding inwardly from a predetermined portion of the annular lip, for dislodging laundry that has become wedged between the annular lip and the rotating drum.

14 Claims, 5 Drawing Sheets

Related Art

GASKET AND DRUM-TYPE WASHING MACHINE HAVING THE SAME

This application claims the benefit of Korean Application No. P2004-009702, filed on Feb. 13, 2004, which is hereby incorporated by reference.

BACKGROUND OF THE INVENTION

1. Field of the Invention

The present invention relates to a washing machine, and more particularly, to a gasket and washing machine having the same, which employs a laundry kicker to prevent laundry from becoming stuck in a gasket during operation.

2. Discussion of the Related Art

Generally speaking, a washing machine is an apparatus which uses detergent and an applied mechanical energy to remove dirt attached to laundry. A tub is provided to hold water and detergent, and laundry is placed in a drum for accommodating the laundry mixed with the water and detergent. The drum, which is installed within the tub, is rotated inside the tub by the drive force of a motor to perform washing, rinsing, and dewatering.

Meanwhile, drum-type washing machines, in which the drum and tub are disposed horizontally, tend to avoid damaging and raveling the laundry and consume less water while achieving a washing effect of beating and rubbing. A general drum-type washing machine is shown in FIG. 1.

Referring to FIG. 1, a cabinet 10 forms an exterior of the washing machine and has a forward opening 14, formed in a front panel 13 of the cabinet, for loading and retrieving laundry via a door 11. A tub 20, suspended within the cabinet 10, has an entrance 21 for communicating with the forward opening 14 of the front panel 13. A drum 30, rotatably installed within the tub and provided with a multitude of perforations 32 to let water pass from the tub to the drum, has a cylindrical shape with an entrance 33 at its front end to communicate with the tub entrance 21. Thus, the forward opening 14, tub entrance 21, and drum entrance 33 compose a laundry opening through which laundry can be loaded into and retrieved from the drum 30. To wash a load of laundry, washing water is supplied to the tub 20, which is then drained using a drain pump 23 and drain hose 24 installed under the tub.

A rotating means 40, such as an induction or BLDC motor for rotating the drum 30 and including a rotational shaft 41 centrally coupled to the rear of the drum, is installed behind the tub 20 and rotates the drum forward and reversely according to the motor's rotational direction. At least one lifter 31 is provided to an inner wall of the drum 30 to assist the washing action by repeatedly lifting the laundry to a predetermined height as the drum is rotated and then allowing the lifted laundry to fall from the predetermined height.

As the drum 30 rotates within the tub 20 under the drive force of the rotating means 40, the drum and tub assembly vibrates. To attenuate the vibration, the tub 20 is supported by an elastic means, including a spring 25 disposed above the tub and a damper 26 disposed below the tub.

A gasket 50 having an essentially annular shape is provided between the cabinet 10 and the tub 20 for preventing water leakage while the door 11 is closed. To achieve leakage prevention, the gasket 50 includes a front rim coupled to the front panel 13 of the cabinet 10 and a rear rim coupled to the entrance 21 of the tub 20, to thereby close a gap existing between the cabinet and tub. Meanwhile, when operating the drum-type washing machine, vibration appearing in the tub 20 may be transferred to the cabinet 10, specifically, to the front panel 13. Therefore, the gasket 50 also serves to compensate for movement in the tub 20 caused by the rotation of the drum 30 and to prevent a transfer of the resulting vibration. To achieve vibration prevention, the gasket 50 includes a shock absorber 51 having an annular shape corresponding to that of the gasket, in which a bent portion is formed between the front and rear rims of the gasket by shaping an excess length of the gasket material into a U-shaped bend.

The gasket 50 also serves to prevent laundry and foreign matter from entering or becoming lodged in a space 33*a*, the entrance to which is located between the tub entrance 21 and the drum entrance 33. Therefore, an annular lip 52, protruding inwardly from a rearward inner wall of the gasket 50, is provided.

In a drum-type washing machine having the gasket 50 according to the related art, laundry tends to become stuck or wedged between the annular lip 52 and the drum 30 while the drum is driven, which damages both the laundry and the gasket. In addition, as the drum 30 continues to be driven, the motor 40 becomes overloaded, which generates undue noise levels and excessive vibration. Moreover, if the motor 40 continues to be driven in this manner, the washing machine is stressed, which diminishes its operational lifetime.

SUMMARY OF THE INVENTION

Accordingly, the present invention is directed to a gasket and drum-type washing machine having the same that substantially obviate one or more of the problems due to limitations and disadvantages of the related art.

An object of the present invention, which has been devised to solve the foregoing problem, lies in providing a gasket and drum-type washing machine having the same, which prevents laundry from becoming wedged in a space between a drum and a gasket for preventing water leakage.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, a gasket coupled between a cabinet of a drum-type washing machine including a drying duct for providing a drying function and a tub disposed inside the cabinet includes an annular lip, protruding inwardly from an inner circumference of the gasket, for preventing foreign matter from entering a space existing between the tub and a rotating drum, and a laundry kicker, protruding inwardly from a predetermined portion of the annular lip, for dislodging laundry that has become wedged between the annular lip and the rotating drum. Preferably, the laundry kicker is disposed at an apex of the annular lip.

The laundry kicker includes a catch having a predetermined thickness, the catch protruding into the drum from a distal end of the laundry kicker and preferably having a tapered lower portion.

In another aspect of the present invention, a washing machine includes a cabinet having a front panel in which a forward opening is centrally formed for loading and retrieving laundry, the cabinet forming an exterior of the washing machine, a tub, disposed behind the front panel, having a tub entrance for communicating with the forward opening, a drum, rotatably installed within the tub, and a gasket coupled between the cabinet and the tub.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
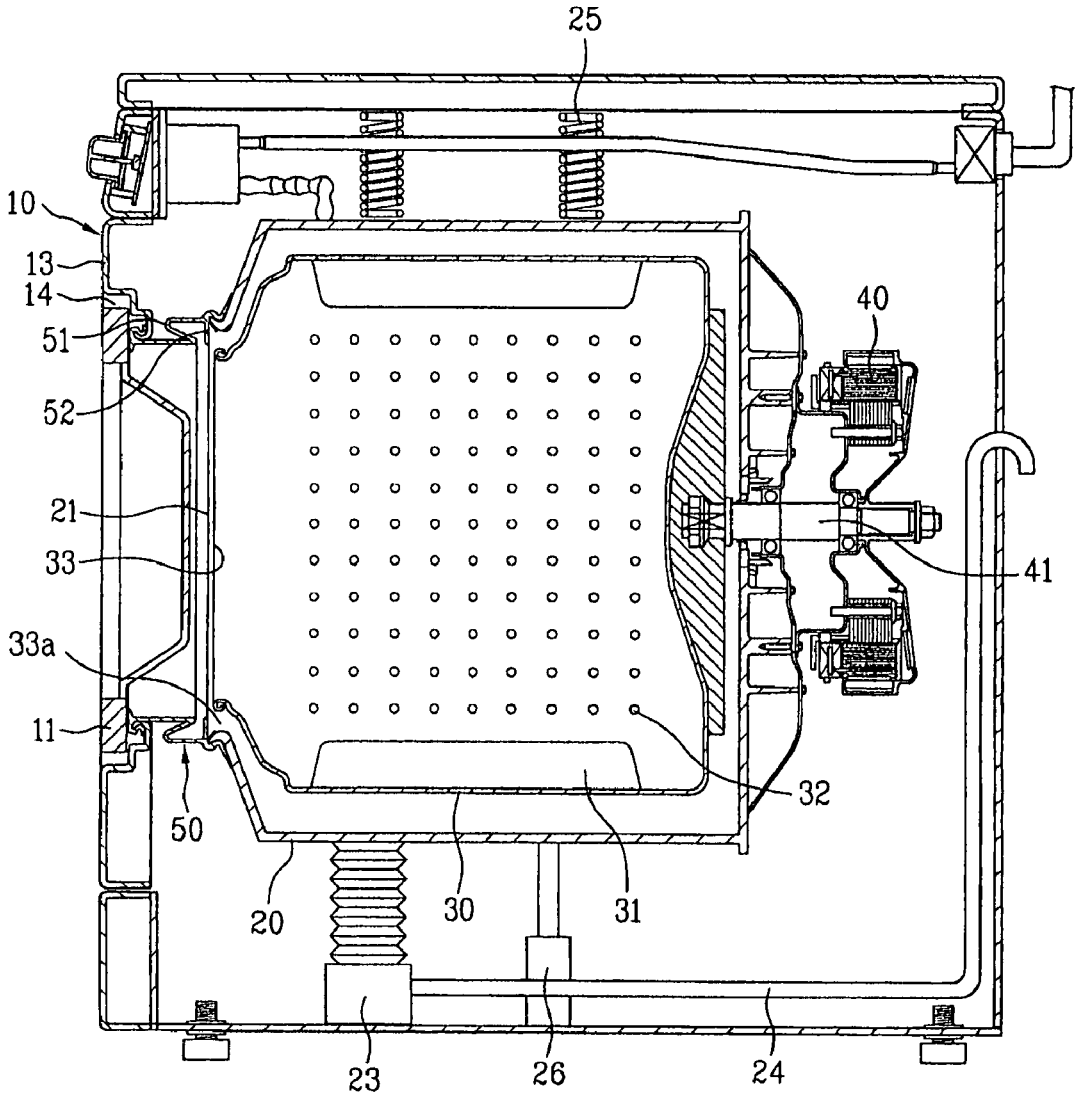
FIG. 1 is a cross-sectional diagram of a drum type washing machine according to a related art.
Figure 2:
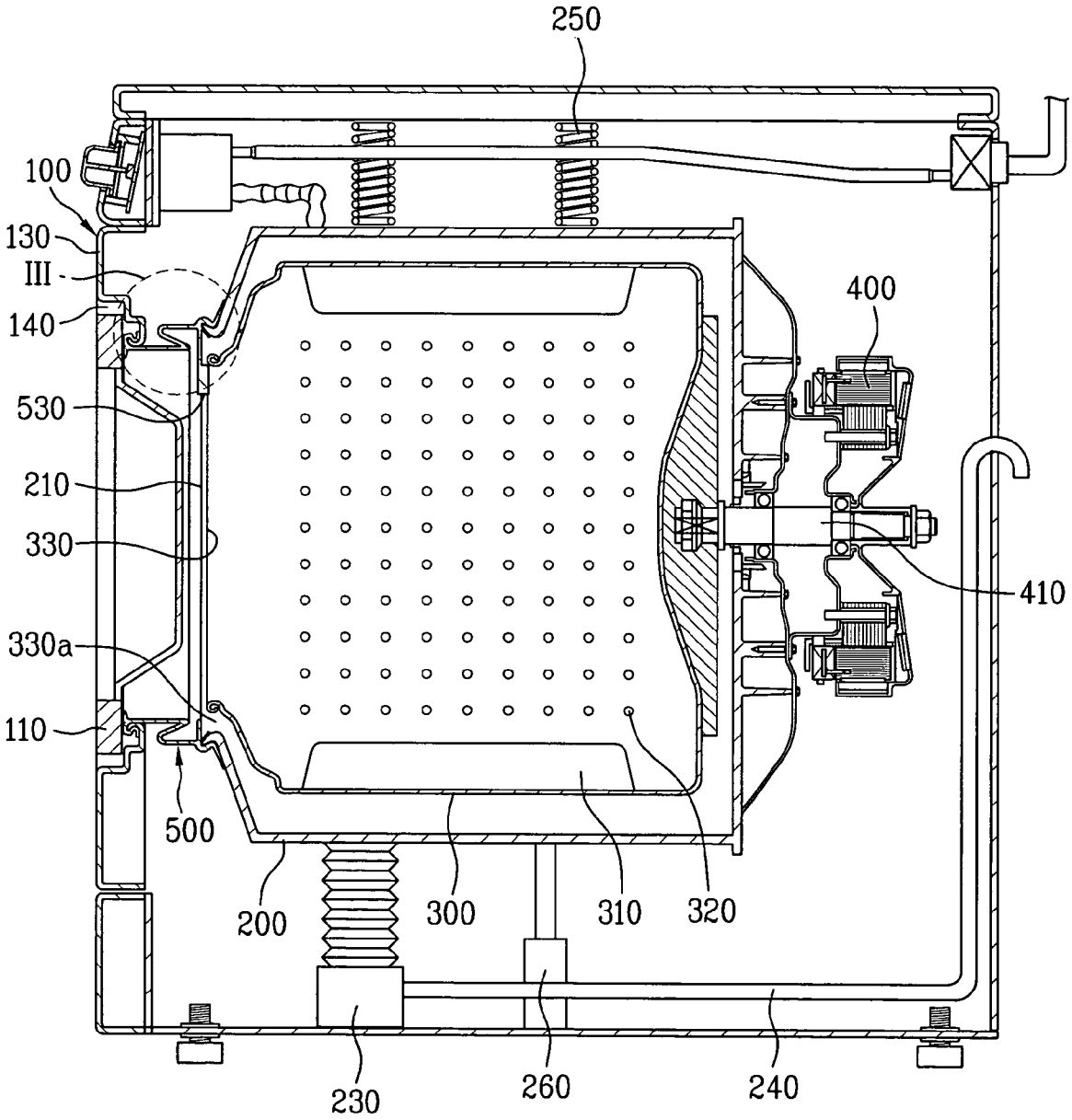
FIG. 2 is a cross-sectional diagram of a drum type washing machine according to the present invention.

Referring to FIG. 2, a drum-type washing machine according to the present invention comprises a cabinet 100 forming an exterior of the washing machine and having a forward opening 140, formed in a front panel 130 of the cabinet, for loading and retrieving laundry via a door 110; a tub 200, suspended within the cabinet 100, having an entrance 210 for communicating with the forward opening of the front panel; and a drum 300, rotatably installed within the tub and provided with a multitude of perforations 320 to let water pass from the tub to the drum, having a cylindrical shape with an entrance 330 at its front end to communicate with the tub entrance. A laundry opening, through which laundry can be loaded into and retrieved from the drum 300, is thus formed by a combination of the forward opening 140, tub entrance 210, and drum entrance 330. A drain pump 230 and a drain hose 240 are installed under the tub 200 for draining washing water supplied to the tub.

A rotating means 400, such as an induction or BLDC motor for rotating the drum 300 and including a rotational shaft 410 centrally coupled to the rear of the drum, is installed behind the tub 200 and rotates the drum forward and reversely according to the motor's rotational direction. At least one lifter 310 is provided to an inner wall of the drum 300 to assist the washing action by repeatedly lifting the laundry to a predetermined height as the drum is rotated and then allowing the lifted laundry to fall from the predetermined height.

To attenuate vibration generated during operation of the drum-type washing machine, the tub 200 is supported by an elastic means, including a spring 250 disposed above the tub and a damper 260 disposed below the tub.

Figure 3:
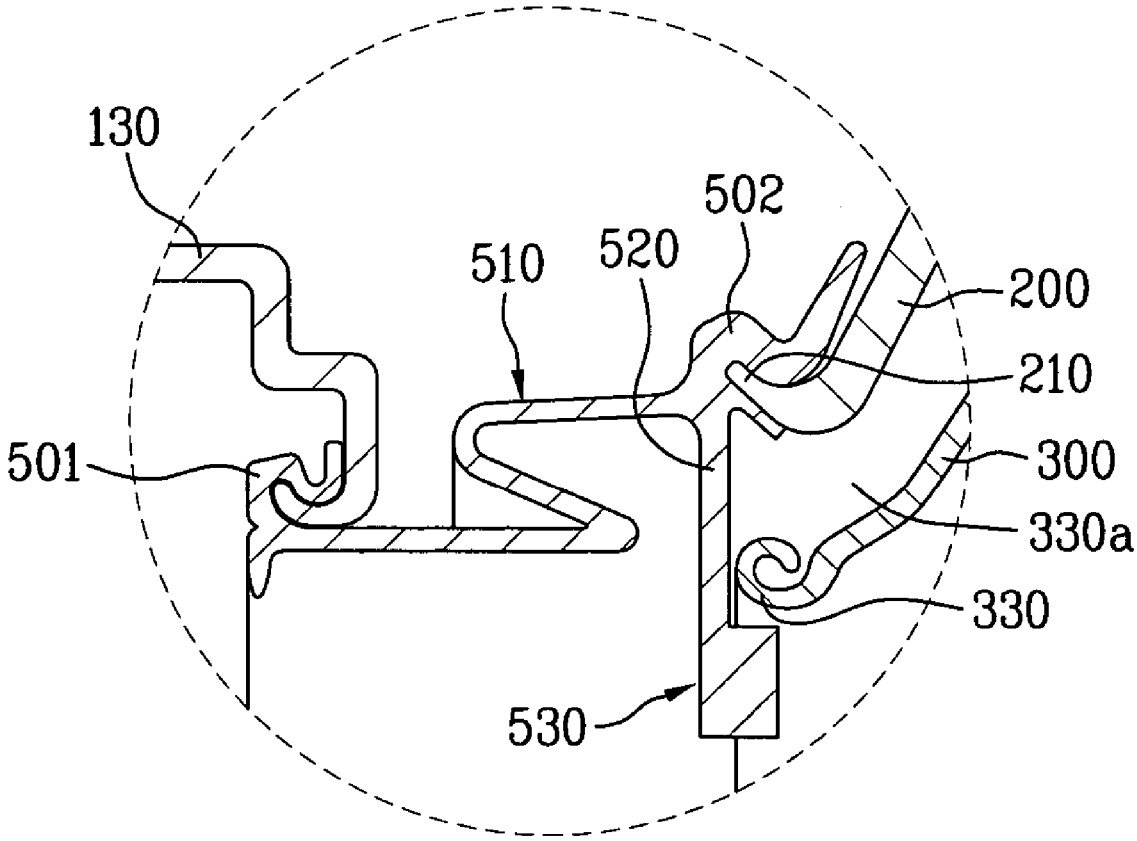
FIG. 3 is an enlarged view of a section III in FIG. 2.
Figure 4:
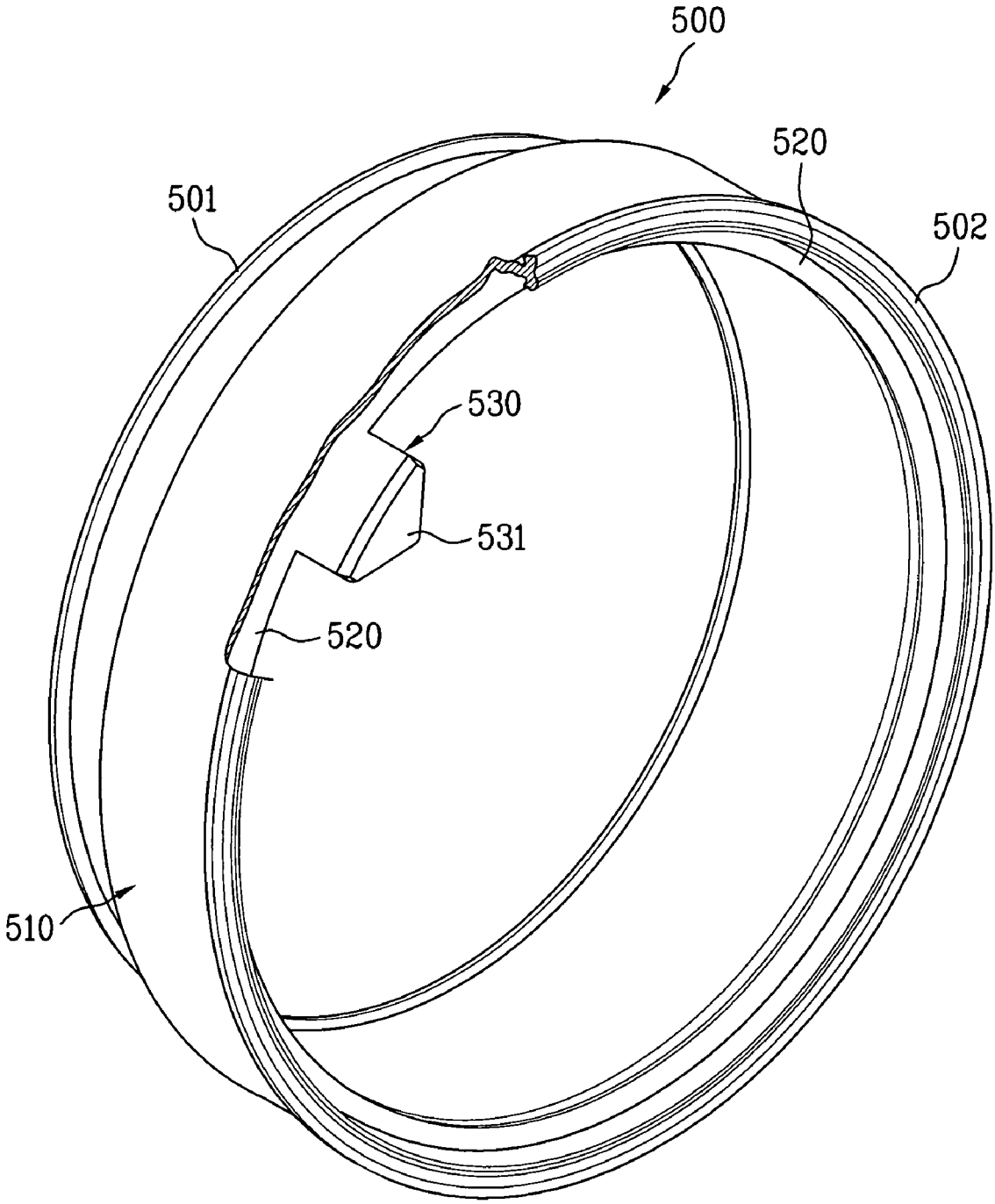
FIG. 4 is a partially cut-away, perspective diagram of a gasket according to the present invention.

According to the present invention, a drum-type washing machine as described above is provided with a gasket 500 as shown in FIGS. 3 and 4. The gasket, having an essentially annular shape, is provided between the cabinet 100 having a front panel 130 and the tub 200 installed behind the front panel, essentially connecting the entrance 210 of the tub to the forward opening 140 of the front panel. The gasket of the present invention is multipurpose. To prevent water leakage, the gasket 500 has a front rim 501 coupled to the front panel 130 of the cabinet 100 and a rear rim 502 coupled to the entrance 210 of the tub 200, thus closing a gap between the cabinet and tub. To prevent a transfer of vibration to the cabinet 100, the gasket 500 includes a shock absorber 510 having an annular shape corresponding to that of the gasket, in which a bent portion is formed between the front and rear rims 501 and 502 of the gasket by shaping a predetermined length of the gasket material into a U-shaped bend. The shock absorber 510 is preferably formed of a soft, pliable material to absorb vibration appearing in the tub 200, by contracting, expanding, and twisting accordingly.

The gasket 500 also serves to prevent laundry and foreign matter from entering or becoming lodged in a space 330*a*, the entrance to which is located between the tub entrance 210 and the drum entrance 330. Therefore, an annular lip 520, protruding inwardly from a rearward inner wall of the gasket 500, is provided. Preferably, the annular lip 530 is integrally formed with the gasket 500 and protrudes inwardly from the rear rim 502, i.e., behind the shock absorber 510. Accordingly, the cutoff part 520 extends from the tub entrance 210 toward the drum entrance 330.

In addition to the above functions, the gasket according to the present invention prevents laundry from becoming wedged (or lodged) between the drum and the gasket itself, specifically, between the annular lip 520 of the gasket 500 and the drum entrance 330. This phenomenon occurs most often while the drum 300 is driven during normal operation, because of its proximity of the annular lip 520, and the phenomenon is exacerbated when the drum is rotated at high speed, for example, during a dewatering cycle to separate water from the laundry using centrifugal force. Therefore, the gasket 500 according to the present invention is provided with a laundry kicker 530, protruding inwardly from a predetermined portion of the annular lip 520, for dislodging laundry that has become wedged between the annular lip and the drum entrance 330 and for preventing further occurrences of such wedging. Preferably, the laundry kicker 530 is disposed at the uppermost point of the gasket 500 as installed in the washing machine, i.e., at the apex of the annular lip 520.

In the event that laundry becomes wedged between the drum 300 and the gasket 500, the laundry kicker 530 returns (or kicks) the laundry back into the drum's interior, using the drum's own rotational force. That is, during normal operation in which the drum 300 is rotated forward and reversely, when laundry becomes wedged between an inner surface of the annular lip 520 and the rotating drum, the wedged laundry will be lifted by the rotational force of the drum and slide along the inner surface of the annular lip until reaching the laundry kicker 530, which has a structure for guiding the laundry away from the gasket 500, to return the previously wedged laundry to the drum and be reintroduced to the bulk of the laundry. To facilitate the laundry's return, the laundry kicker 530 has a distal (or inward) end on which a catch 531 having a predetermined thickness is formed to protrude into the drum 300. The laundry kicker 530 extends from the annular lip 520 to a point beyond the forward edged of the drum entrance, to span a gap between annular lip and the drum entrance, whereby the wedged laundry rotating with the drum is forced from (or escapes) its wedged position. Accordingly, the laundry kicker 503 is stepped to enhance its laundry-collecting capability. That is, if the laundry kicker 530 were to be formed to have one thickness, i.e., consistent with that of the annular lip 520, the wedged laundry would tend to slide behind the annular lip as the drum 300 rotated, thus bypassing the laundry kicker, and may fail to be returned to the drum. Accordingly, the laundry kicker 530 includes a stepped portion formed between an inward surface of the annular lip 520 and an inward surface of the catch 531.

Figure 5:
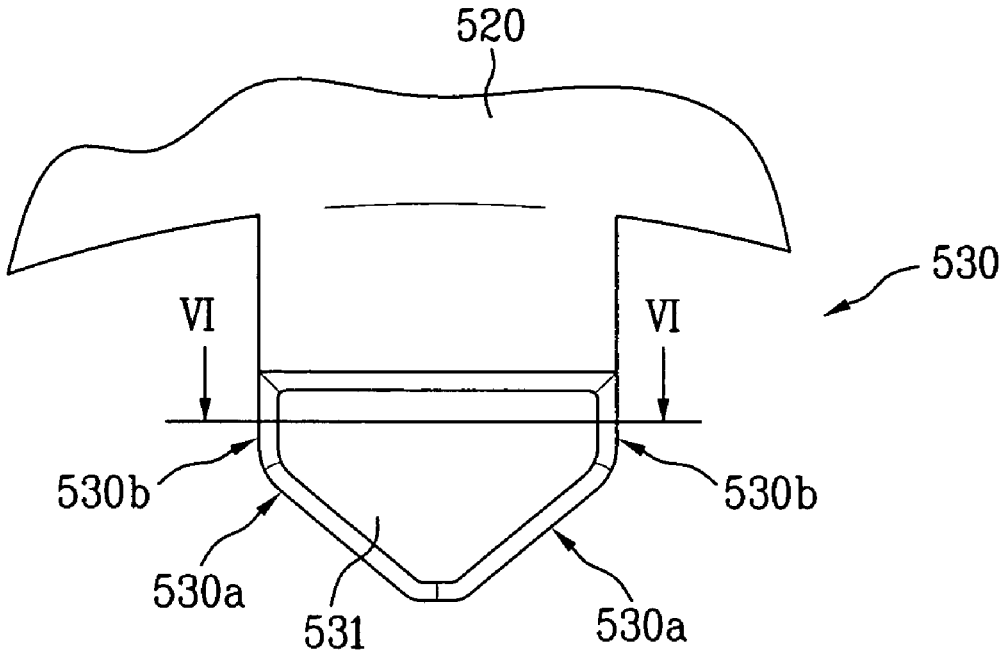
FIG. 5 is a diagram of a laundry kicker of the gasket in FIG. 4.
Figure 6:
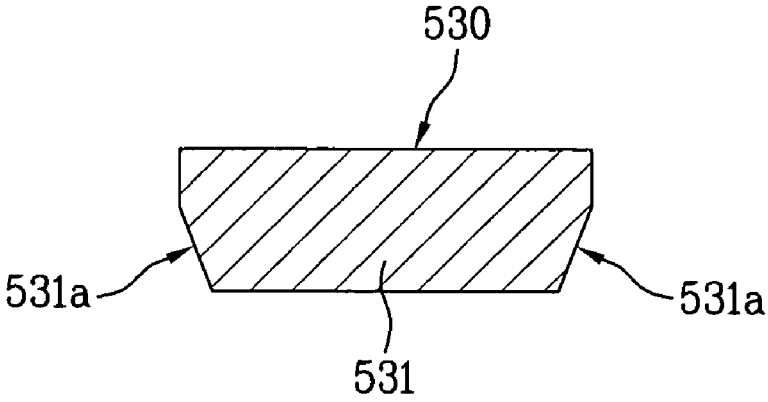
FIG. 6 is a cross-sectional view taken along line VI-VI of FIG. 5.

Referring to FIGS. 5 and 6, a horizontal cross-section of the laundry kicker 530 decreases in width toward its tip, to impart the laundry kicker 530 with a tapered lower portion. That is, the laundry kicker 530 preferably has lower sides 530*a* formed at a predetermined angle with respect to its upper sides 530*b* and includes chamfered faces 531*a* formed on the rearward edges of the upper and lower sides. This structure facilitates a smooth return of wedged laundry to the drum 300. That is, as the drum 300 rotates and the wedged laundry rises to meet the laundry kicker 530, the lower sides 530*a* gently pull the wedged laundry from its wedged position, to allow the laundry to drop into the drum's interior, thereby guiding the laundry back into the drum. Since the laundry kicker 530 is symmetrical along a vertical plane perpendicular to an inner surface of the annular lip 520 of the gasket 500, its structure is compatible with either rotational direction of the drum 300.

During operation of a washing machine adopting the gasket of the present invention, if laundry becomes wedged between the annular lip 520 and the drum entrance 330, the laundry is raised to a point on the circumference of the annular lip under the force of the rotating drum, i.e., to the location of the laundry kicker 530, the laundry comes into contact with the laundry kicker and escapes from its wedged position to be guided along the lower sides 530*a* and the chamfered faces of the catch 531, and then is dropped to be collected in the drum 300.

By adopting a gasket according to the present invention, an annular lip prevents laundry from entering a space between the tub and the drum. Furthermore, the laundry kicker provided to the gasket removes laundry wedged between the gasket and the drum entrance and prevents further incidence of laundry becoming similarly wedged, and therefore, in addition to providing damage prevention benefits to both the laundry and the gasket itself, the laundry kicker also prevents such wedging from causing noise and vibration, which prevents overloading of the motor and thus prolongs the life of the washing machine.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A gasket coupled between a cabinet of a drum-type washing machine including a drying duct for providing a drying function and a tub disposed inside the cabinet, the gasket comprising:

an annular lip, protruding inwardly from an inner circumference of the gasket, for preventing foreign matter from entering a space existing between the tub and a rotating drum; and a laundry kicker including a stepped portion and a tapered lower portion decreasing symmetrically in width towards its tip, protruding inwardly from a predetermined portion of the annular lip, for dislodging laundry that has become wedged between the annular lip and the rotating drum wherein the laundry kicker is disposed at an apex of the annular lip.

2. The gasket as claimed in claim 1, wherein the laundry kicker extends downward from the apex of the annular lip.

3. The gasket as claimed in claim 1, wherein the laundry kicker is symmetrical along a line perpendicular to an inner surface of the annular lip.

4. The gasket as claimed in claim 1, wherein the laundry kicker comprises a catch having a predetermined thickness, the catch protruding into the rotating drum from a distal end of the laundry kicker.

5. The gasket is claimed in claim 4, wherein the catch has a tapered lower portion.

6. The gasket as claimed in claim 4, wherein the stepped portion of the laundry kicker is formed between an inward surface of the annular lip and an inward surface of the catch.

7. The gasket as claimed in claim 4, wherein the catch comprises lower edges formed to have a predetermined angle with respect to upper sides.

8. The gasket as claimed in claim 4, wherein the upper and lower sides respectively comprise chamfered faces formed on inward edges of the upper and lower sides.

9. The gasket as claimed in claim 4, wherein the laundry kicker is symmetrical with respect to a plane perpendicular to an inner surface of the annular lip.

10. The gasket as claimed in claim 1, further comprising a shock absorber having a bent shape for preventing a vibration appearing in the tub from being transferred to the cabinet.

11. A washing machine comprising:

a cabinet having a front panel in which a forward opening is centrally formed for loading and retrieving laundry, the cabinet forming an exterior of the washing machine;

a tub, disposed behind the front panel, having a tub entrance for communicating with the forward opening:

a drum, rotatably installed within the tub; and a gasket coupled between the cabinet and the tub, the gasket comprising:

an annular lip, protruding inwardly from an inner circumference of the gasket, for preventing foreign matter from entering a space existing between the tub and the drum; and a laundry kicker including a stepped portion and a tapered lower portion decreasing symmetrically in width towards its tip, protruding inwardly from a predetermined portion of the annular lip, for dislodging laundry that has become wedged between the annular lip and the drum, wherein the laundry kicker is disposed at an apex of the annular lip.

12. The gasket as claimed in claim 11, wherein the laundry kicker comprises a catch having a predetermined thickness, the catch protruding into the drum from a distal end of the laundry kicker.

13. The washing machine as claimed in claim 12, wherein the catch has a tapered lower portion.

14. The washing machine as claimed in claim 11, further comprising a shock absorber having a bent shape for preventing a vibration appearing in the tub from being transferred to the cabinet.

* * * * *